United States Patent [19]

Crawford et al.

[11] 4,034,984

[45] July 12, 1977

[54] LACROSSE STICK

[75] Inventors: William C. Crawford, Owings Mills; Jackie L. Davis, Aberdeen, both of Md.

[73] Assignee: Wm. T. Burnett & Co., Incorporated, Baltimore, Md.

[21] Appl. No.: 620,396

[22] Filed: Oct. 7, 1975

[51] Int. Cl.[2] ..... A63B 59/02; A63B 49/02

[52] U.S. Cl. ..... 273/96 D; 273/73 D

[58] Field of Search ..... 273/96 D, 73 D, 73 L; 46/DIG. 1

[56] References Cited

U.S. PATENT DOCUMENTS

| | | | |
|---|---|---|---|
| 3,547,440 | 12/1970 | Deer | 273/73 D |
| 3,820,785 | 6/1974 | Occwipinti | 273/73 D |
| 3,874,667 | 4/1975 | Christopher | 273/73 D |
| 3,910,578 | 10/1975 | Brine | 273/96 D |

FOREIGN PATENT DOCUMENTS

| | | | |
|---|---|---|---|
| 424,742 | 2/1935 | United Kingdom | 273/96 D |
| 1,238,182 | 7/1971 | United Kingdom | 273/73 D |

*Primary Examiner*—Richard C. Pinkham
*Assistant Examiner*—Arthur S. Rose
*Attorney, Agent, or Firm*—A. W. Breiner

[57] ABSTRACT

A double-wall, synthetic lacrosse stick including tab means for attachment or formation of the web on the head of the lacrosse stick is described. Preferably the tabs, molded integral with the end and side walls of the head, project inwardly from the extreme upper surface of the walls of the head and are substantially flush with this upper surface. Improved durability and enhanced play characteristics are realized.

7 Claims, 10 Drawing Figures

LACROSSE STICK

FIELD OF INVENTION

This invention relates in general to new an useful improvements in lacrosse sticks. More particularly, it relates to the construction of a double-wall, synthetic lacrosse stick comprising tab means for securing the web on the head of the lacrosse stick to the side and end walls of the double-wall frame.

BACKGROUND AND PRIOR ART

Double-wall, synthetic lacrosse sticks are described in Tucker et al, U.S. Pat. No. 3,507,495. As a result of the introduction of the lacrosse stick defined in that patent which has improved feel, balance, and durability as well as uniformity and economy of manufacture in comparison to the single-wall, wooden and handmade lacrosse stick used since ancient times, the popularity of the game of lacrosse has increased greatly and is becoming quite common in intramural and varsity sport programs of secondary schools and colleges. The introduction of the mesh webbing construction described in Tucker et al, U.S. Pat. No. 3,822,062 has further simplified the fabrication of lacrosse sticks and permits greater latitude in modifications to individual play.

Although the above-noted construction of lacrosse sticks is highly satisfactory as determined by the substantially universal acceptance of these sticks, it has been recognized for some time that the weakest area of the head of the lacrosse stick is that area surrounding or adjacent to holes in the walls of the head for attachment or formation of the web to or on the head. This weakened area can be removed at least in part by chamfering the holes to eliminate the sharp edges. However, this presents molding problems and /or fabrication difficulties. Although breakage of the head as a result of the weakness in the area of hole formation is not substantial, perfection of the stick design and construction is desired.

OBJECTS AND GENERAL DESCRIPTION OF THE INVENTION

Accordingly, an object of this invention is to provide a double-wall, synthetic lacrosse stick having substantially uniform strength throughout the double side walls thereof.

Another object of this invention is to provide a double-wall, synthetic lacrosse stick having greater ease of attachment or formation of the web to or on head of the lacrosse stick.

Still another object of this invention is to provide a double-wall, synthetic lacrosse stick having improved playing characteristics.

Other objects and advantages of the present invention will become apparent from the following general and detailed description taken in conjunction with the appended drawing.

Briefly, the aforesaid and other objects and advantages are obtained by constructing or molding the double-wall lacrosse stick with tab means to wholly or in part eliminate the holes in the walls of the stick used to attach or form the web of the stick. The provision of the tab means to eliminate the holes provides a stick having substantially uniform strength throughout the walls thereof and, additionally, permits more rapid attachment or formation of the web to or on the stick head. Surprisingly, by constructing the tabs integral with the end and side walls of the head of the double-wall stick, and positioning the tabs at the extreme top or upper surface of the end and side walls of the stick and substantially flush with the top or upper surface, improved playing characteristics are obtained with the stick. This improved play apparently is due to the free-hanging character, or free-suspension of the web which permits greater flexibility in forming or adjusting the ball pocket of the web.

DRAWING AND DETAILED DESCRIPTION

In the drawing, where like parts of the various embodiments are designated by like numerals, FIG. 1 is a plan view from the top of the preferred embodiment of the lacrosse stick partly in section;

FIG. 1*a* is a section through lines 1*a*—1*a* of FIG. 1 looking in the direction of the arrows, the webbing being omitted;

FIG. 2 is a plan view of a second embodiment of the head alone, i.e., the handle and web being omitted;

FIG. 2*a* is a section through lines 2*a*—2*a* of FIG. 2 looking in the direction of the arrows;

FIG. 2*b* is a modification to the stick design shown in FIGS. 2 and 2*a;*

FIG. 2*c* is a second modification to the stick design shown in FIGS. 2 and 2*a;*

FIG. 3 is a plan view showing the bottom or lower surface of another embodiment of the present invention;

FIG. 3*a* is a section through lines 3*a*—3*a* of FIG. 3 looking in the direction of the arrows;

Figure 1:
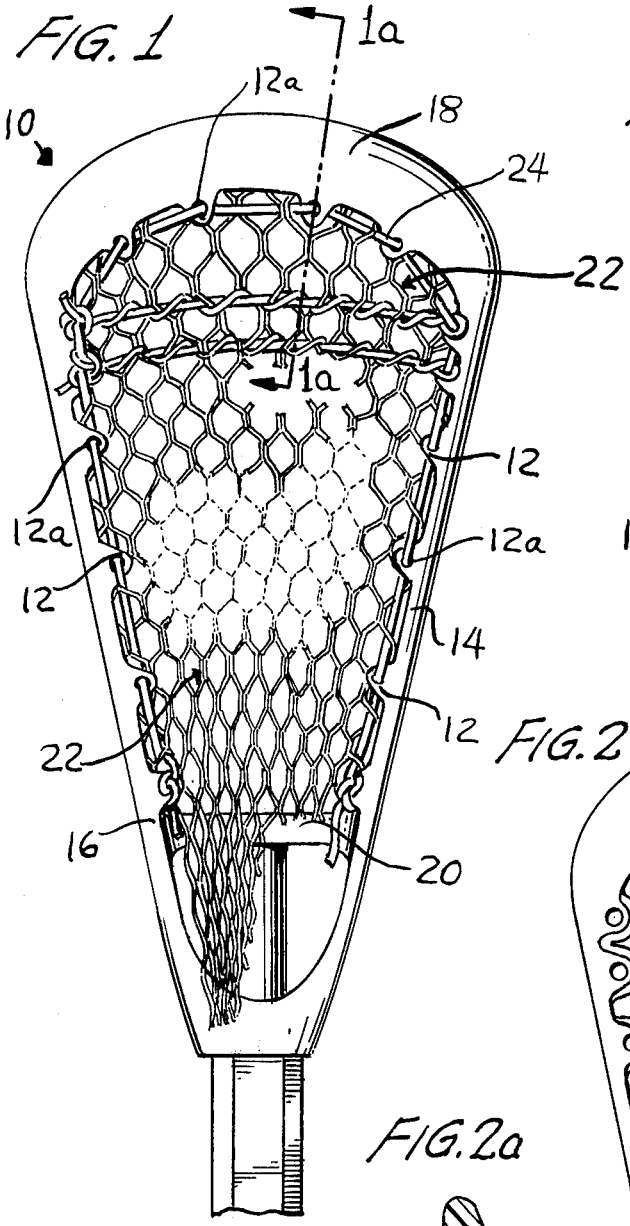
Figure 1A:
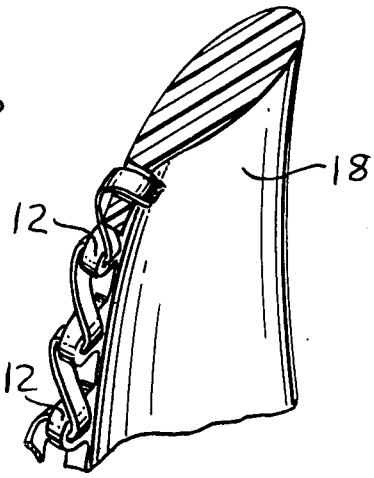
Figure 2:
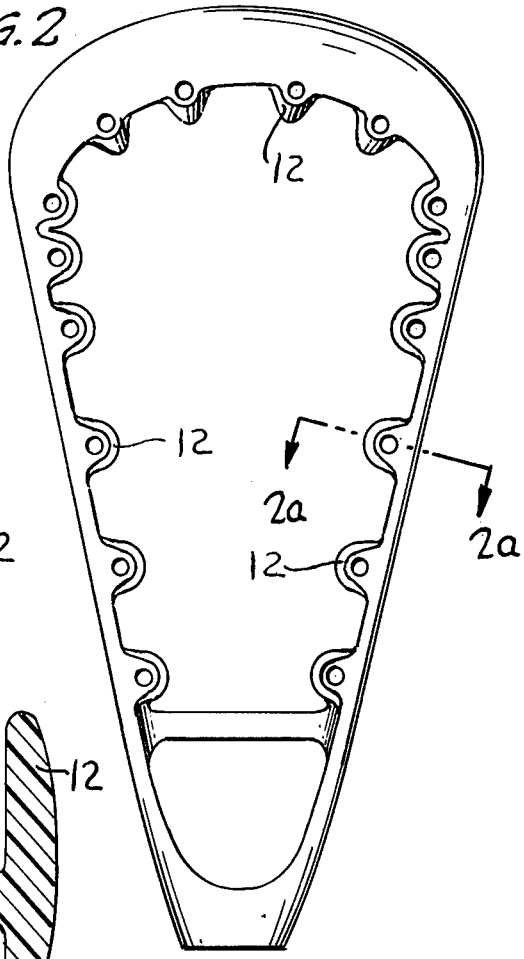
Figure 3:
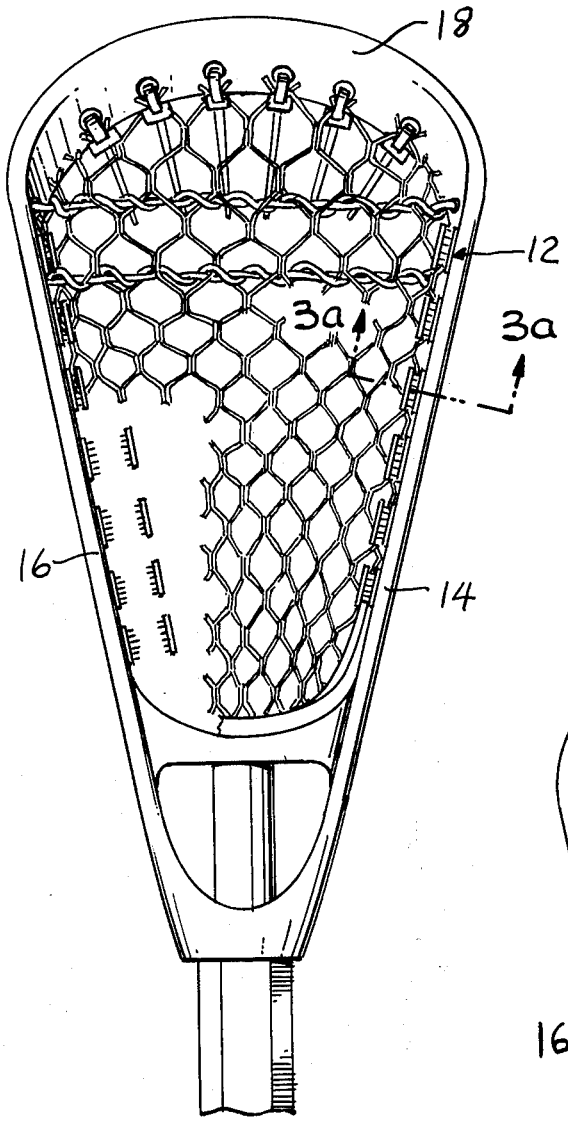

Referring to FIGS. 1 and 2 of the drawing, in the preferred embodiment, tabs 12 are molded integral with the extreme top or upper surface, i.e., the surface receiving the web in the embodiment of FIG. 1, or the surface through which the web extends in the embodiment of FIGS. 2 and 3, and projects inwardly from side walls 14 and 16 and transverse end wall 18. The integral flush nature of the positioning of the tabs to the end and side walls is more clearly illustrated in FIG. 1*a* where the webbing is omitted. The tabs 12 are spaced around the end and side walls and extend to stop 20 which interconnects side walls 14 and 16. A mesh webbing 22, as described in aforesaid U.S. Pat. No. 3,822,062, is secured to the stick head generally designated 10 by lacing string 24 through holes 12*a* in tabs 12. The web, being free-hanging or suspended from tabs 12, positioned flush with the upper surface, and projecting inwardly of end wall 18 side walls 14 and 16, permits variation in the formation of the pocket of the web, enhancing individual play characteristics. However, since the tabs are substantially flush with the upper surfaces and directed inwardly of the end and side walls, no interference with play is experienced. In other words, the tabs so positioned, although permitting the free suspension of the web, will not engage or catch onto a player's clothing while checking or the like in competition, nor will the tabs cause injury to a competitive player as a result of scraping engagement with the player. As is apparent, the tabs so positioned contribute to the clean, sharp design of the double-wall lacrosse stick.

Figure 2A:
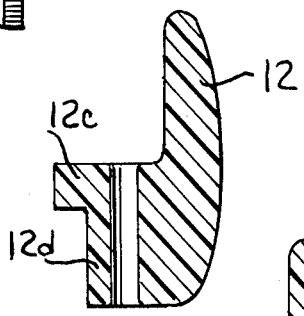
Figure 2B:
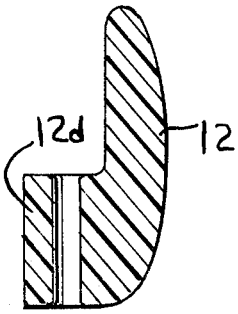
Figure 2C:
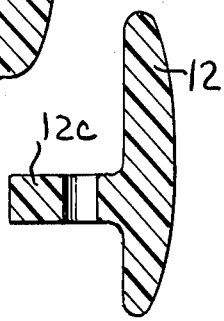

The embodiment of FIG. 2 is a variation of the design of FIG. 1. According to this embodiment, tabs 12, which are integral with end wall 18 and side walls 14 and 16, extend substantially to the middle of the side walls and to the middle of the plane of the transverse end wall. This design, while serviceable, does not provide the free hanging or free suspension of the webbing of the embodiment illustrated in FIG. 1 and, accordingly, does not permit the same individual play characteristics. However, the embodiment of FIG. 2 can be modified by cutting away section 12*c* of FIG. 2*a* as shown in FIG. 2*b* to give substantially the embodiment of FIGS. 1 and 1*a*. By cutting away section 12*d* of FIG. 2*a*, the design of FIG. 2*c* is provided. As apparent, according to the design of FIG. 2*c*, the web will be suspended from the substantial center of the walls of the stick.

Figure 3A:
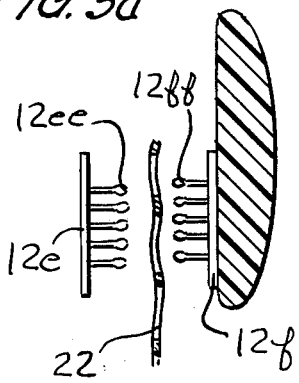

In the embodiment of FIGS. 3 and 3*a*, the tab means 12 comprise mating units 12*f* and 12*e*. Unit 12*f*, bonded to side walls 14 and 16, includes protrusions 12*ff* which engage webbing 22 and together with protrusions 12*ee* on unit 12*e* lock the mesh to the side walls. Although in the embodiment of FIG. 3 holes are utilized in transverse end wall 18, as apparent mating units 12*f* and 12*e* can also be utilized on end wall 18 if desired.

Figure 4:
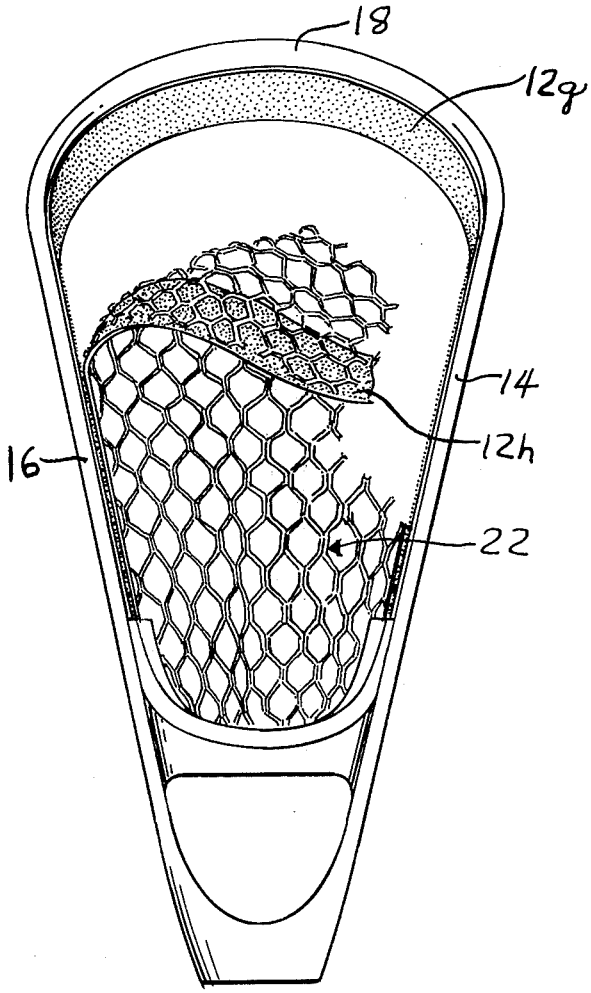
FIG. 4 is still a further embodiment of the present invention.

According to FIG. 4, the tab means, as the term or phrase is employed herein, comprise complementing unitary strip 12*g* secured to end wall 18 and side walls 14 and 16 of the stick head, and strip 12*h* which engages webbing 22 and makes locking contact with strip 12*g*. Suitable materials are commercially known and are sold, for example, under the tradename VELCRO.

Figure 5:
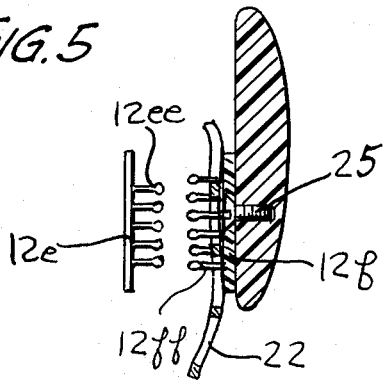
FIG. 5 is a modification of the embodiment shown in FIGS. 3 and 3*a*.

As will be readily apparent, various modifications can be made in the inventive concept expressed herein. For example, the tab means, whether a single piece as shown in FIG. 2 or as complementing units as shown in FIGS. 3 and 3*a*, can be secured to the walls of the lacrosse stick head by various means including integral molding, adhesive bonding, or by attachment with screws. Note FIG. 5 where unit 12*f* of FIGS. 3 and 3*a* is secured to the side walls by screw means 25. Moreover, although strips 12*g* and 12*h* of FIG. 4 are unitary, they can be segmented. As will also be apparent, the selection of the synthetic material for fabricating the double-wall lacrosse stick head can be any polymer material which will provide the necessary flexibility, toughness, and hardness. The synthetic material and the method of fabrication as disclosed in aforesaid U.S. Pat. No. 3,507,495 are preferred because of exceptional properties and ease of fabrication. These modifications and others, being within the ability of one skilled in the art, are within the spirit of this invention and the scope of the appended claims.

It is claimed:

1. A head for a lacrosse stick comprising a generally V-shaped frame adapted to receive a web, said frame being defined by two side walls joined at a juncture and diverging therefrom, a transverse wall joining the ends of said side walls opposite of said juncture, and tab means positioned on at least said side walls for securement of a web onto said frame, said tab means being integrally formed with at least said side walls and constructed and arranged therewith to project inwardly thereof and substantially flush with the top surface thereof.

2. The head for a lacrosse stick according to claim 1 wherein said tab means are also on said transverse wall.

3. A lacrosse stick comprising a head for a lacrosse stick according to claim 1, a web attached to said head, and a handle fitted to the juncture of said side walls.

4. A head for a lacrosse stick comprising a generally V-shaped frame adapted to receive a web, said frame being defined by two side walls joined at a juncture and diverging therefrom, a transverse wall joining the ends of said side walls opposite of said juncture, and tab means positioned on at least said side walls for securement of a web onto said frame, said tab means comprising a plurality of first and second mated units, the first of said mated units being attached in spaced relation to at least said side walls of said head, and the second of said mated units constructed and arranged to lock a web to said first unit when said first and second units are in cooperative association.

5. The head for a lacrosse stick according to claim 4 wherein said first of said mated units are adhesively bonded to said side walls.

6. The head for a lacrosse stick according to claim 4 wherein said first of said mated units are attached to said side walls by screws.

7. A head for a lacrosse stick comprising a generally V-shaped frame adapted to receive a web, said frame being defined by two side walls joined at a juncture and diverging therefrom, a transverse wall joining the ends of said side walls opposite of said juncture, and tab means positioned on at least said side walls for securement of a web onto said frame, said tab means including a continuous first strip secured to the side walls and transverse wall and a second continuous strip secured to web means on said head, and said first and second units are interlocked.

* * * * *